US005085118A

United States Patent [19]

Sekizuka

[11] Patent Number: 5,085,118

[45] Date of Patent: Feb. 4, 1992

[54] AUTO-ACCOMPANIMENT APPARATUS WITH AUTO-CHORD PROGRESSION OF ACCOMPANIMENT TONES

[75] Inventor: Makoto Sekizuka, Iwata, Japan

[73] Assignee: Kabushiki Kaisha Kawai Gakki Seisakusho, Shizuoka, Japan

[21] Appl. No.: 630,191

[22] Filed: Dec. 19, 1990

[30] Foreign Application Priority Data

Dec. 21, 1989 [JP] Japan ..... 1-332340

[51] Int. Cl.[5] ..... G10H 1/38; G10H 1/42

[52] U.S. Cl. ..... 84/635; 84/637; 84/DIG. 12; 84/DIG. 22

[58] Field of Search ..... 84/611-613, 84/635-637, DIG. 12, DIG. 22

[56] References Cited

U.S. PATENT DOCUMENTS 4,327,622 5/1982 Aoki ..... 84/DIG. 12

*Primary Examiner*—Stanley J. Witkowski

[57] ABSTRACT

An auto-accompaniment apparatus for an electronic musical instrument which includes an accompaniment pattern storage means and chord progression pattern storage means. These accompaniment pattern and chord progression pattern are programmed in the storage means for each type of rhythms. Accompaniment pattern data and the chord progression pattern data are read out from the storage means in response to selection of rhythm. A modifier modifies accompaniment notes in the accompaniment pattern data in accordance with programmed chord name in the chord progression pattern data. A tone generator generates accompaniment tones on the basis of the modified accompaniment notes.

9 Claims, 5 Drawing Sheets

AUTO-ACCOMPANIMENT APPARATUS WITH AUTO-CHORD PROGRESSION OF ACCOMPANIMENT TONES

BACKGROUND OF THE INVENTION

1. Field of the Invention

The present invention relates to an automatic accompaniment apparatus which generates bass and chord tones along with rhythm performance and more particularly to an accompaniment apparatus suitably incorporated with an electronic musical instrument such as an electronic piano.

2. Description of the prior art

In the past, as an automatic accompaniment apparatus for an electronic musical instrument, there is known the apparatus in which a chord root note and a chord type such as major, minor and so on are designated on an accompaniment keyboard arranged on the left side area of a manual keyboard unit (e.g. see U.S. Pat. No. 4,184,401). In this prior art accompaniment apparatus, bass and chord patterns are programmed for two or more bars in an accompaniment pattern memory along with rhythm patterns on the basis of C-major chord consisting of C-, E- and G-notes. The bass and chord patterns are repeatedly read out at a given tempo speed. The performer performs melodies on the upper keyboard with his or her right hand and performs accompaniment on the lower keyboard with left hand for designation of chord type and root note. Pitches of the programmed chord notes are shifted from the C-major chord in accordance with designated chord type and root note so that accompaniment tones are generated.

Accordingly, in the prior art automatic accompaniment apparatus for an electric musical instrument, the performer operates keys with right hand for melody performance and concurrently with left hand for chord designation for accompaniment performance. It is difficult especially for a beginner to operate keyboard skillfully for his satisfactory performance as he must pay his attention to one of melody and accompaniment performances with another almost neglecting.

SUMMARY OF THE INVENTION

Accordingly, it is an object of the present invention to provide an automatic accompaniment apparatus in which chords for accompaniment performance are automatically progressed without designation of chord name (chord type and chord root).

In accordance with an aspect of the present invention, as shown in the fundamental block diagram of FIG. 2, there are provided an automatic accompaniment apparatus having an accompaniment pattern storage means 6 in which accompaniment pattern data for auto-accompaniment performance is stored for each rhythm. The apparatus further comprises chord progression pattern storage means 13 in which chord progression patterns are programmed for respective types of rhythm. Rhythm selection means 2*a* is provided for selecting one of rhythms. Read-out means 3*a* reads out the accompaniment pattern data and the chord progression pattern data respectively from the accompaniment pattern storage means 6 and the chord progression pattern storage means 13 in response to a type of rhythm selected through the rhythm selection means 2*a*. Data processing means 3*b* is provided to receive the accompaniment pattern data and the chord progression pattern data from the read-out means 3*a*. The data processing means 3*b* generates accompaniment tone data by modifying accompaniment notes in the accompaniment pattern data in accordance with chord progression specified by the chord progression pattern. Tone generating means 8 generates accompaniment tones in accordance with the accompaniment tone data generated in the data processing means 3*b*.

When a desired rhythm is selected through the rhythm selection means 2*a*, the programmed chord progression pattern is read out in response to the selected rhythm. Accompaniment chords are shifted automatically in accordance with the programmed chord progression.

DETAILED DESCRIPTION OF A PREFERRED EMBODIMENT

Figure 7:
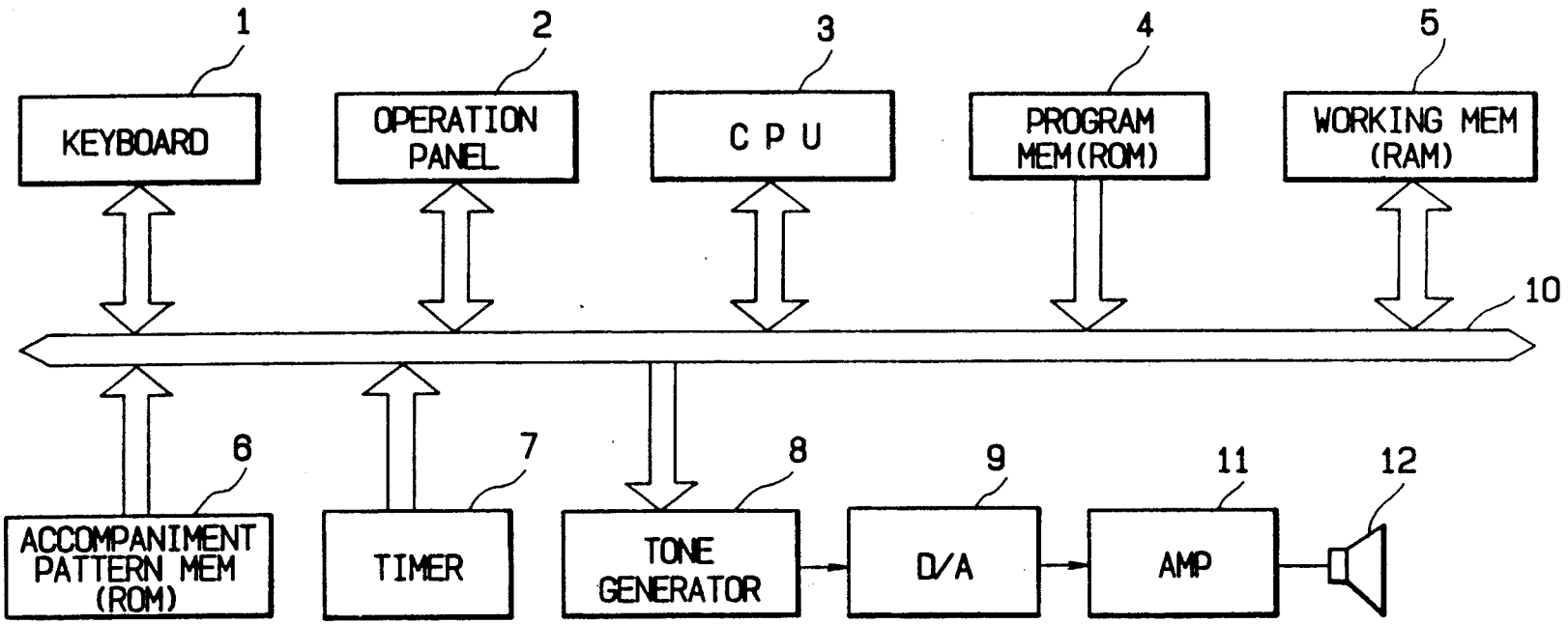
FIG. 7 PRIOR ART
FIG. 7 is a block diagram of a prior art electronic musical instrument.

For better understanding of the embodiment of this invention, a prior art electronic musical instrument with automatic accompaniment performance is explained with referring to FIG. 7.

In FIG. 7, to a bus line 10, a keyboard 1, an operation panel 2, CPU 3, a program ROM 4, a working RAM, an accompaniment pattern ROM 6, a timer 7 and a tone generator 8 are connected. These elements communicate with each other.

The tone generator 8 generates tone signals which are converted to analog melody tone signals and accompaniment tone signals through a D/A converter 9. The melody and accompaniment tone signals are fed to a loudspeaker 12 with amplified through an amplifier 11.

The keyboard 1 has key arrangement and interfaces for outputting key signals from respective keys. In this electronic instrument, ten or more keys on the left side of the keyboard are assigned to keys for accompaniment chord designation when an automatic accompaniment mode is elected. Other keys on the keyboard are utilized for melody performance.

The operation panel 2 has many operation buttons for tone color control and play control and interfaces for outputting signals therefrom.

The CPU 3 performs scanning detection of the keyboard and the operation buttons and then performs data processing for tone generation, accompaniment pattern reproduction and so on in response to detection of keys or operation buttons in accordance with a stored program in the program ROM 4.

The working RAM 5 temporarily stores data processed in the CPU 3.

A number of auto-accompaniment pattern data each consisting of paired rhythm pattern, bass pattern and chord pattern are stored in the accompaniment pattern ROM 6 for every types of rhythm.

The rhythm pattern is stored to generate a predetermined sequence of percussive sounds by one or more percussion instruments, in unit of rhythm such as waltz, tango, rumba and so on.

The bass pattern and the chord pattern are stored to generate bass accompaniment tones and chord accompaniment tones based on a reference chord, e.g. C-major chord. For example, the bass pattern is stored to generate bass performance corresponding to a bass line written in C-major chord along with respective rhythm. The chord pattern is stored as an accompaniment pattern written in C-major chord for a predetermined accompaniment instrument such as a guitar or piano along with respective rhythm.

These three patterns are respectively stored for a period corresponding to one or two bars.

The timer 7 controls tempo of a selected rhythm.

When keys on the keyboard 1 are depressed for melody performance, tone signals are generated in the tone generator 8 in response to operation of keys. The tone signals are converted into melody tone signals in the D/A converter 9 and supplied to the loudspeaker 12 through the amplifier 11 to generate melody sound.

When a selector (not shown) arranged on the operation panel 2 for rhythm selection is operated to select a desired rhythm such as waltz, tango and so on, a pair of rhythm pattern, bass pattern and chord pattern are read out from the accompaniment pattern ROM 6 in accordance with selected rhythm. The CPU 3 produces tone data according to the patterns for generating accompaniment tones. The tone generator 8 generates tone signals on the basis of the tone data.

The tone signals are converted into analog accompaniment tone signals in the D/A converter 9 and supplied to the loudspeaker 12 to generate accompaniment tones. In a case when only a type of rhythm is designated, bass accompaniment and chord accompaniment correspond to C-major chord tones which are repeatedly generated along with rhythm accompaniment by percussion instrument every one or two bars. Chord designation processing is necessary in practice for generating bass tones and chord tones as illustrated below.

The performer depresses accompaniment keys on the keyboard 1 to designate desired chord name (root note and chord type). When accompaniment keys corresponding to notes composing a desired chord are depressed, accompaniment of C-major chord are changed to a tones of desired chord. The tone pitches of elemental tones composing the bass accompaniment and chord accompaniment are shifted in accordance with the chord designation.

The performer therefore selects a desired rhythm, then performs a melody line with his right hand while operates keys with his left hand for designating accompaniment chord. Music with accompaniment consisting of percussion tones, bass tones and chord tones is thus performed in accordance with a selected rhythm.

Figure 1:
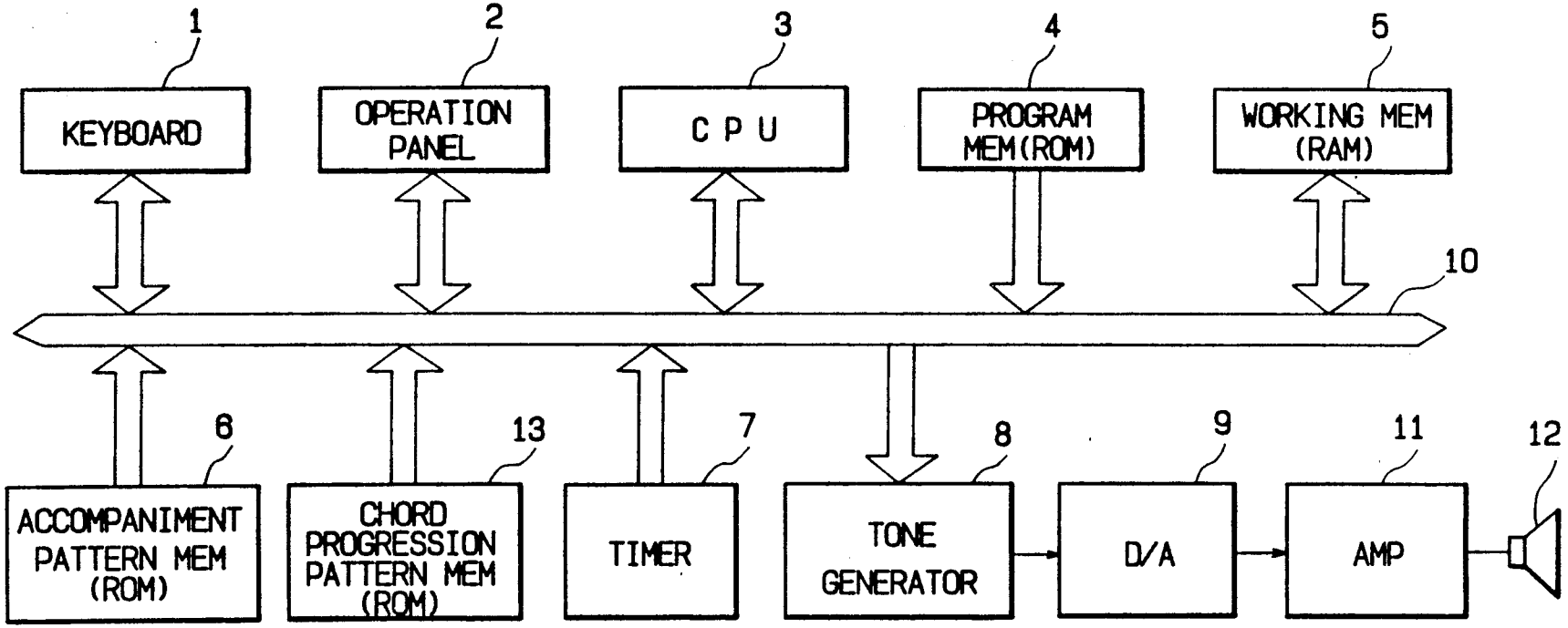
FIG. 1 is a block diagram of an electronic musical instrument with an automatic accompaniment apparatus according to an embodiment of this invention.
Figure 2:
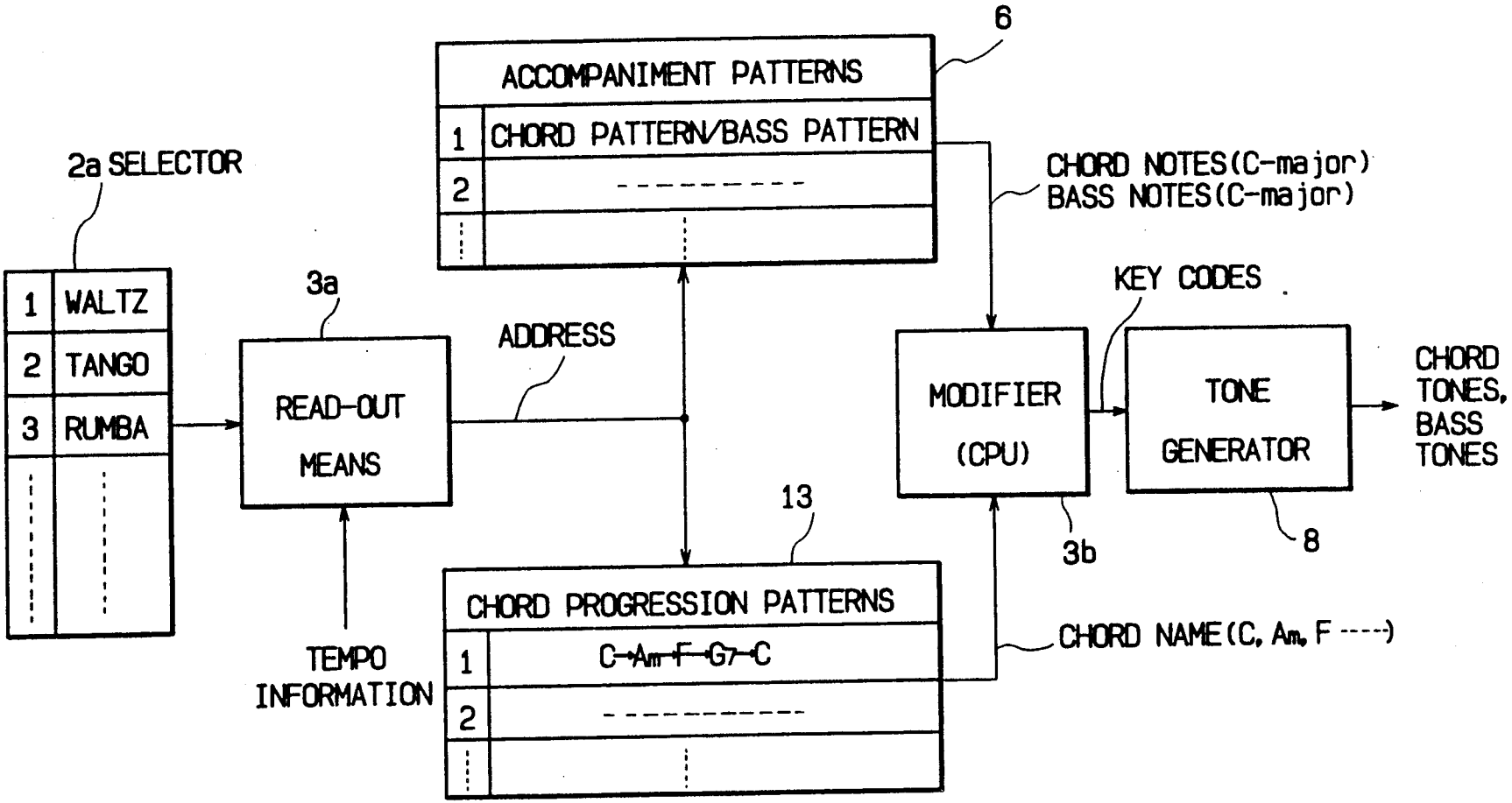
FIG. 2 is a block diagram showing an elemental feature of this invention.

Next, the automatic accompaniment apparatus according to an embodiment of this invention will be illustrated with referring to FIG. 1 in which identical numerals are attached to identical elements with those in FIG. 7 for simplifying explanation. FIG. 2 shows blocks corresponding to an elemental feature of this invention.

As shown in FIG. 1, a chord progression pattern ROM 13 in which chord progression sequences are stored is connected to the bus line 10. In the chord progression sequence pattern ROM 13, various chord sequences are stored in correspondence to various rhythms selectable with a selector 2*a* arranged on the operation panel 2 for rhythm selection. For example, a chord progression sequence, e.g. C--Am--F--G7--C is preset and stored for the rhythm of waltz. To the other rhythms such as tango, rumba, etc. chord progression sequence patterns different from each other are preset and stored.

The CPU 3 performs rhythm processing, timer processing, pattern data read-out and data processing in addition to the aforementioned various processing, in accordance with programs stored in the program ROM 4.

Next, operation of the automatic accompaniment performance using the chord progression sequence pattern ROM 13 will be explained.

On the operation panel 2, arranged are an operation button for executing the auto-accompaniment performance, a selector 2*a* for selecting a type of rhythm, and an operation button for setting auto-chord sequence mode. These buttons and selector are operated to set auto-accompaniment performance mode and auto-chord sequence mode, and then to select a desired rhythm. A read-out means 3*a* comprised of CPU 3 outputs addresses in response to the selected type of rhythm to read out a chord progression sequence pattern from the chord progression pattern ROM 13 as well as corresponding rhythm pattern, bass pattern and chord pattern from the auto-accompaniment pattern ROM 6.

CPU 3 generates accompaniment tone data by directly applying accompaniment information consisting of the bass pattern data and chord pattern data read out from the accompaniment pattern ROM 6 in a case when the chord progression sequence pattern data indicates a C-major chord. The chord progression sequence pattern data is fed to the tone generator 8 together with rhythm accompaniment data generated on the basis of the rhythm pattern data. When the chord progression sequence pattern data indicates a chord other than C-major chord, a modifier 3*b* comprised of CPU 3 shifts pitches of respective tones constituting the bass accompaniment and chord accompaniment by some degrees on the basis of the bass pattern data and chord pattern data read out from the accompaniment pattern ROM 6. Accompaniment tone data are thereby generated in accordance with programmed progression of chord to perform accompaniment. The accompaniment tone data are fed to the tone generator 8 together with rhythm accompaniment data on the basis of rhythm pattern data.

Bass accompaniment tones and chord accompaniment tones are thus obtained at the loudspeaker 12. These accompaniment tones automatically vary in chord along with time passage in accordance with the chord progression sequence pattern read out in response to a selected type of rhythm. A performer therefore can obtain auto-accompaniment having chord progression along with melody performance in this auto-chord progression sequence mode without using her or his left hand to designate chord. The performer can keep her or his mined on melody performance in this automatic mode. The auto-chord progression sequence mode may stop when a chord name is designated on the accompaniment keyboard.

The chord progression sequence pattern ROM 13 may store two kind of chord sequences for each rhythm, one based on C-chord for major chord progression and another based on Am-chord for minor chord progression. A performer may designates a note, e.g.

F-note on the keyboard when accompaniment based on F-major chord is intended. The chord progression sequence pattern based on C-major chord may be automatically shifted to a chord progression sequence pattern based on the F-major chord. In addition, major and minor chord progression sequences may be stored in unit of rhythm. A performer can designate one of the chord sequences in addition to the rhythm selection. Further more, a plurality of chord progression sequence patterns may be preset for one rhythm. A performer can select one of chord sequence patterns in order to combine with a selected rhythm.

Next, steps of data processing in CPU 3 will described in connection to the operation of the chord progression sequence mode with referring to flowcharts shown in FIGS. 3–6.

Figure 3:
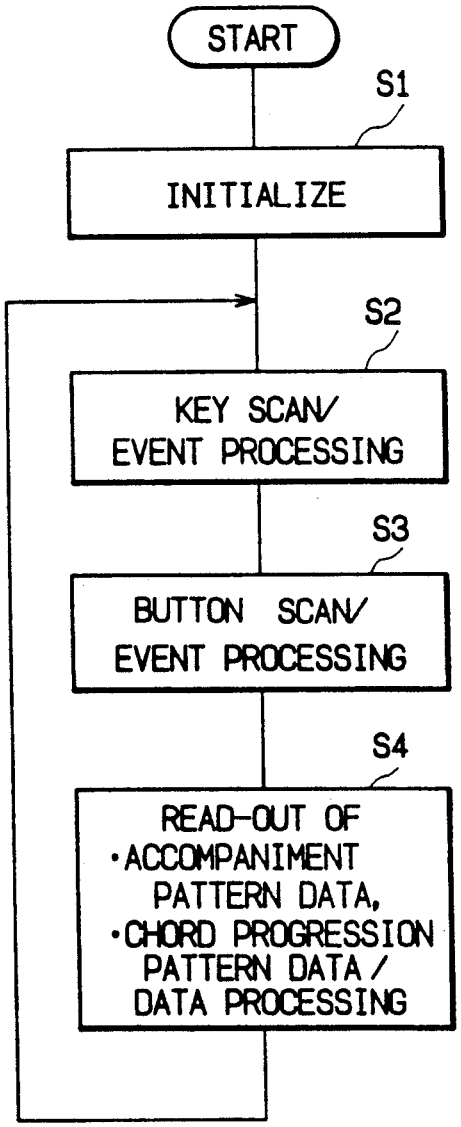
FIG. 3–6 are flowcharts showing data processing for an automatic accompaniment performance according to the embodiment.

FIG. 3 shows general processing steps of a main routine.

First, the system is initialized in step S1, then scan detection of the keyboard 1 and event(key-on/off) processing is performed in step S2, in which all of the keys on the keyboard 1 are scanned to detect operation thereof and a necessary processing is executed when change(key event) in operation state of any key is detected.

Next, scan detection of operation buttons on the operation panel 2 and event processing thereof are carried out in step S3, in which all of the buttons on the operation panel 2 are scanned to detect operation thereof and a necessary processing is executed when change(event) in operation state of any button is detected.

Next, in step S4, data read-out of the accompaniment pattern and the chord progression sequence pattern is carried out, then the read out data are processed. In this step S4, data are read out from the accompaniment pattern ROM 6 and the chord progression pattern ROM 13 and then processed, in accordance with event information detected in steps S2 and S3.

Figure 4:
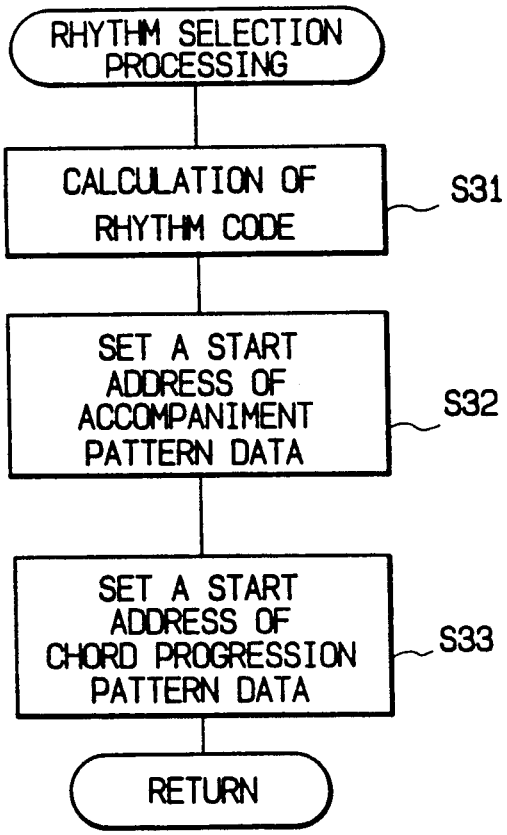

FIG. 4 shows a subroutine corresponding to rhythm selecting processing included in the step S3 of FIG. 3.

This rhythm select processing is carried out when an ON-event to select one of rhythms on the rhythm selector *2a* in the operation panel 2 is detected in step S3 of FIG. 3. At the start, a rhythm code corresponding to the rhythm selected through the rhythm selector *2a* is calculated in step S31.

Next, in step S 32, a start address of stored accompaniment pattern data is set in accordance with the rhythm code calculated in step S31.

Next, in step S33, a start address of stored chord progression sequence pattern data is set in accordance with the rhythm code calculated in step S31.

Figure 5:
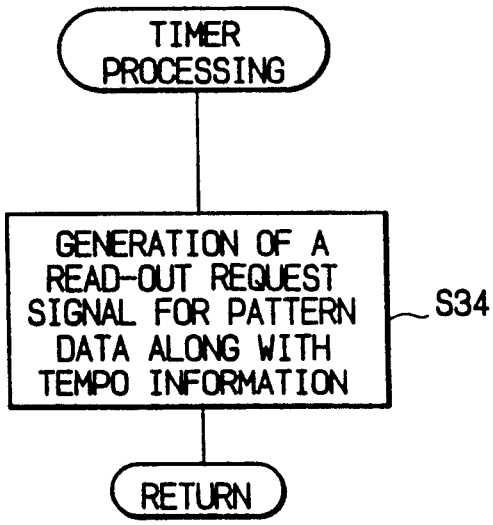

FIG. 5 shows a timer processing routine.

In this timer processing, the timer 7 generates a read-out request signal for reading out the auto-accompaniment pattern data and the chord progression sequence pattern data according to tempo information of performance.

Successive read-out request signals are generated at the timer 7 in accordance with a tempo preset through a tempo selection button on the operation panel 2 in FIG. 1 to read out the auto-accompaniment pattern data and the chord progression sequence pattern data respectively from the pattern ROMs 6 and 13, in step S34 of this timer processing.

Figure 6:
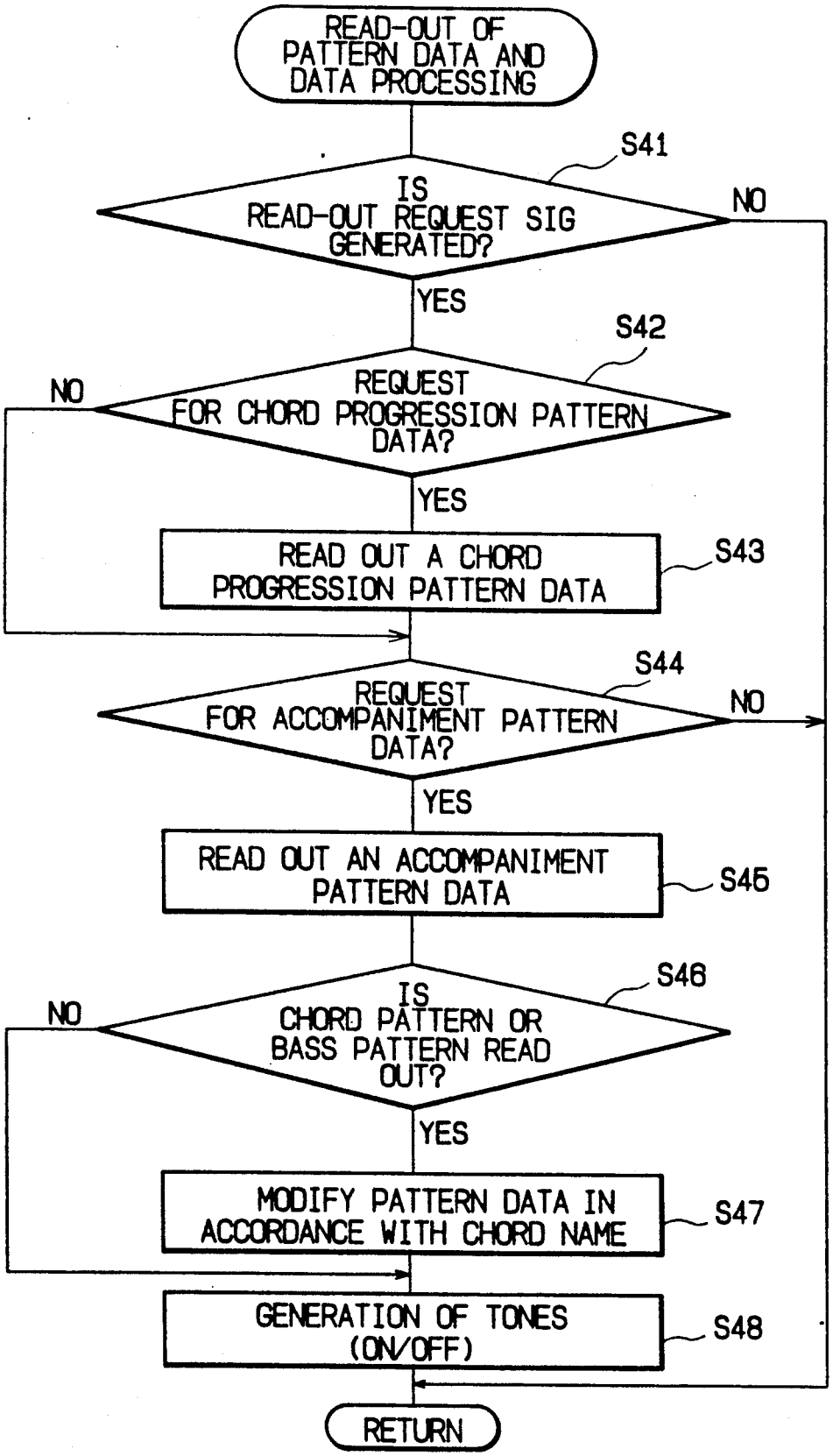

FIG. 6 shows a subroutine corresponding to step S4 of FIG. 3 to carry out reading of the pattern data and processing of the data.

At the start, step S41 judges whether a read-out request signal is generated or not in the timer processing of FIG. 5. When a read-out request signal is generated, step S42 judges in the next place whether a chord progression sequence pattern data is requested or not. The flow goes to step S44 described later in a case where the chord pattern data is not requested.

In a case where a chord progression sequence pattern data is requested, next in step S43, a chord progression data is read out of the chord sequence pattern ROM 13 at a preset address thereof and the read out data, e.g. a chord name is written in the working RAM 5.

Next, step S44 judges whether an auto-accompaniment pattern data is requested or not. The flow returns to the main routine of FIG. 3 when the data is not requested. When the auto-accompaniment pattern data is requested, an auto-accompaniment pattern data is read out from the auto-accompaniment pattern ROM 6 at a preset address thereof to be written in the working RAM 5.

Next, the flow goes to step S46 to judge whether the read out auto-accompaniment pattern data is a chord patter data or a bass pattern data. If a chord pattern data or a bass pattern data is read out, next in step S47, tone data corresponding to chord accompaniment tones or bass accompaniment tones are generated on the basis of the chord pattern data or the bass pattern data in accordance with the chord progression data written in the working RAM 5. Particularly, key codes (key numbers) in the accompaniment data for designating tone pitches of desired accompaniment tones are modified (shifted by some degrees) in accordance with the chord name specified by the programmed chord progression data.

In the next step S48, processing of tone generation is carried out to generate chord accompaniment tones or bass accompaniment tones in response to the modified accompaniment data. If in step S46 the auto-accompaniment data is judged not to correspond to any bass pattern data and chord pattern data and judged to indicate a rhythm pattern data, the flow goes directly to step S48 to perform tone generation processing for generating percussive rhythm tones.

Modification may be made in this invention without limited to the above-mentioned preferred embodiment. For example, chord accompaniment to be modified by the chord progression sequence pattern may be performed with other instruments such as a brass than a guitar or a piano, or with others inclusive of brass. Accompaniment may be performed with various styles such as arpeggio. The accompaniment pattern data may include only one of the chord accompaniment and bass accompaniment.

According to the present invention, in a summary, patterns of typical chord progression sequence are stored in unit of rhythm. Chords of chord accompaniment or bass accompaniment by guitar or piano sound can be progressed automatically in accordance with selected type of rhythm. There is no necessity for a performer to designate chord name with her of his left hand. The performer can keep her or his mined on melody performance. Especially, a beginner can give a performance without difficulty. An ad lib performance may be practiced along with the auto-chord progression. The accompaniment keyboard utilized to designate chord names may be assigned to melody performance so that notes for melody line can be extended to widen a range of musical performance.

What is claimed is:

1. An automatic accompaniment apparatus having an accompaniment pattern storage means in which accompaniment pattern data for auto-accompaniment performance is stored for each rhythm, the apparatus comprising:

chord progression pattern storage means in which chord progression patterns are preset for respective types of rhythm;

rhythm selection means for selecting one of rhythms;

read-out means for reading out said accompaniment pattern data and said chord progression pattern data respectively out of said accompaniment pattern storage means and said chord progression pattern storage means in response to a type of rhythm selected through said rhythm selection means;

data processing means receiving said accompaniment pattern data and said chord progression pattern data from said read-out means and generating accompaniment tone data by modifying accompaniment notes in the accompaniment pattern data in accordance with chord progression specified by said chord progression pattern; and tone generating means for generating accompaniment tones in accordance with said accompaniment tone data generated in said data processing means.

2. An automatic accompaniment apparatus according to claim 1, wherein said accompaniment pattern data include chord pattern data.

3. An automatic accompaniment apparatus according to claim 1, wherein said accompaniment pattern data include bass pattern data.

4. An automatic accompaniment apparatus according to claim 2, wherein said accompaniment pattern data include bass pattern data.

5. An automatic accompaniment apparatus according to claim 3, wherein said accompaniment pattern data include rhythm pattern data.

6. An automatic accompaniment apparatus according to claim 4, wherein said accompaniment pattern data include rhythm pattern data.

7. An automatic accompaniment apparatus according to claim 1, wherein said chord progression pattern data consist of a sequence of chord names.

8. An automatic accompaniment apparatus according to claim 1, wherein said data processing means comprises modifying means which shifts said accompaniment notes in the accompaniment pattern data by degrees specified by a chord name in said chord progression pattern data.

9. An automatic accompaniment apparatus according to claim 1, wherein said accompaniment pattern data consist of a sequence of reference chords accompanied with rhythm information.

* * * * *